United States Patent [19]

Hajicek

[11] Patent Number: 4,497,361

[45] Date of Patent: Feb. 5, 1985

[54] REGENERATIVE HEAT AND HUMIDITY EXCHANGING APPARATUS

[76] Inventor: David J. Hajicek, 14824 Glendale Rd., Minnetonka, Minn. 55343

[21] Appl. No.: 273,355

[22] Filed: Jun. 15, 1981

[51] Int. Cl.[3] ..... F28D 19/00

[52] U.S. Cl. ..... 165/7; 55/390; 165/8; 165/9; 165/10; 165/5; 261/83

[58] Field of Search ..... 165/8, 7, 10, 9, 5, 165/54; 55/390; 261/83

[56] References Cited

U.S. PATENT DOCUMENTS

| | | | |
|---|---|---|---|
| 3,211,213 | 10/1965 | Baxley et al. | 165/9 |
| 3,977,466 | 8/1976 | Johansson | 165/7 X |
| 3,990,503 | 11/1976 | Ostbo | 165/7 X |
| 4,331,198 | 5/1982 | Michalska | 165/9 |

FOREIGN PATENT DOCUMENTS

| | | | |
|---|---|---|---|
| 2130077 | 12/1972 | Fed. Rep. of Germany | 165/8 |

*Primary Examiner*—Albert W. Davis, Jr.

*Attorney, Agent, or Firm*—Schroeder, Siegfried, Vidas & Arrett

[57] ABSTRACT

The apparatus includes a housing that is divided into two parallel passages. A fan in one passage causes air from the outside of a building to flow through one of the passages into the building and a fan in the other passage causes air to be exhausted from inside the building to the outside. A flapper valve prevents entrance of air into the building through either passage when the fans are not operating. A series of media disks, two embodiments of which are disclosed, constitute successive stages, picking up heat and/or moisture from one passage and transferring the heat and/or moisture to the other passage as the disks are rotated within recesses formed in stationary separators. A special drive mechanism is utilized for rotating the disks. Provision is also made for spraying the disks in order to clean them and/or to control the humidity within the building.

16 Claims, 14 Drawing Figures

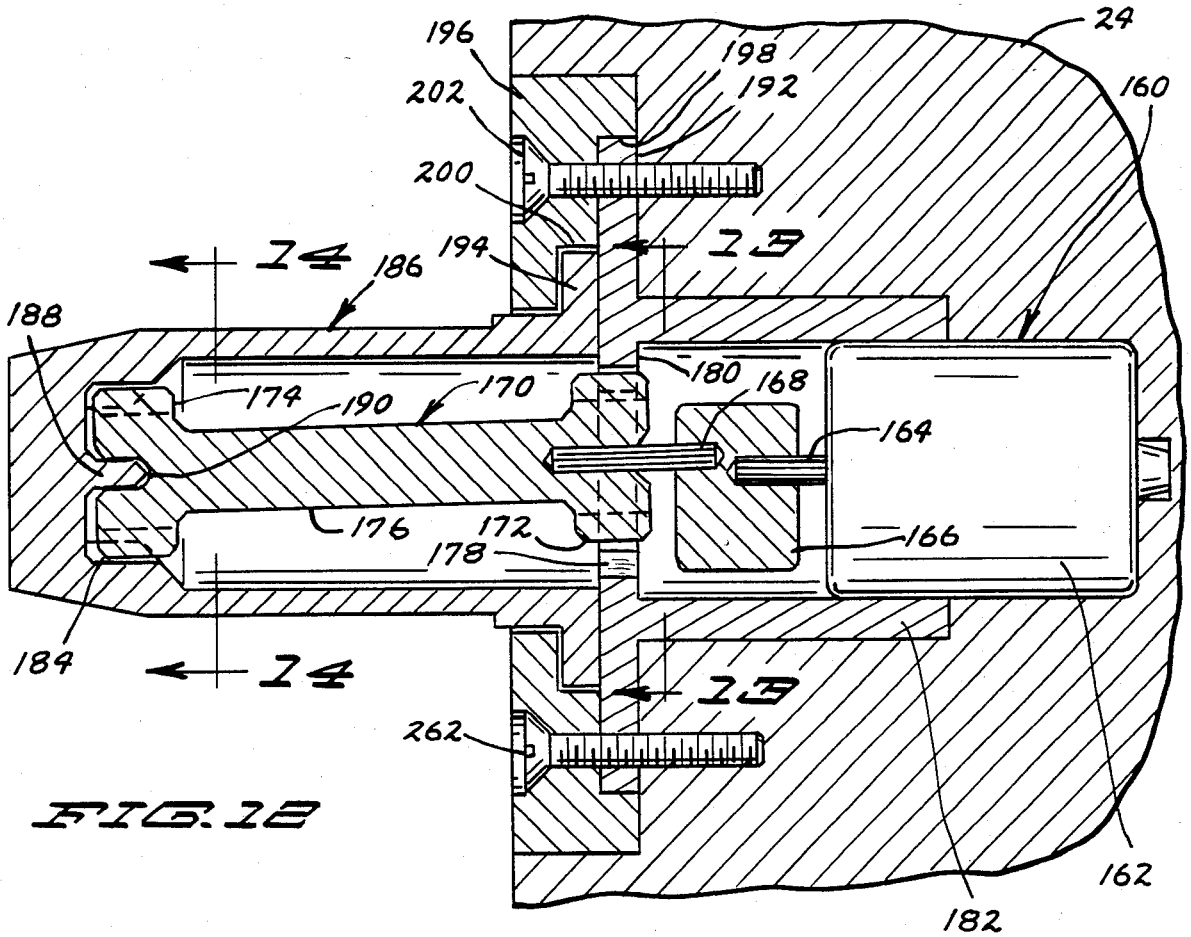
FIG. 12
FIG. 13
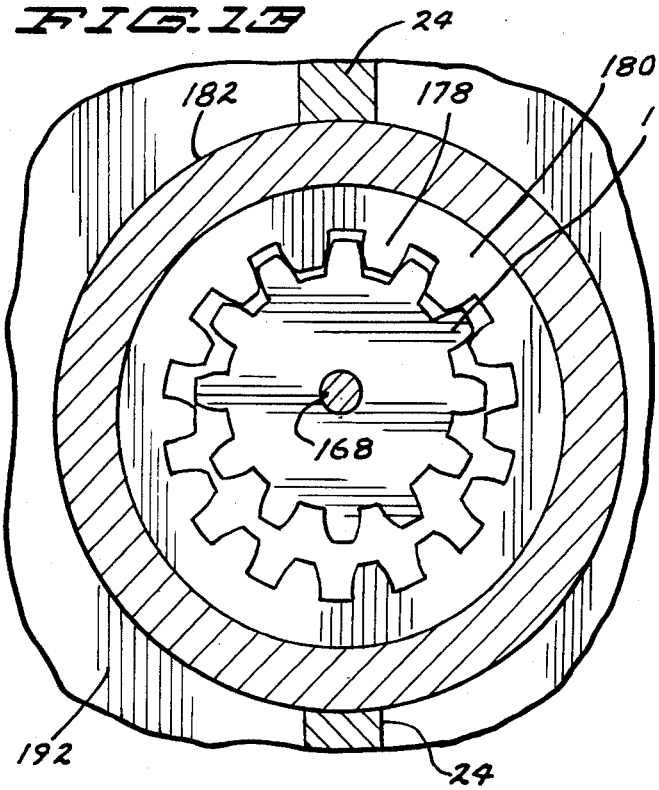
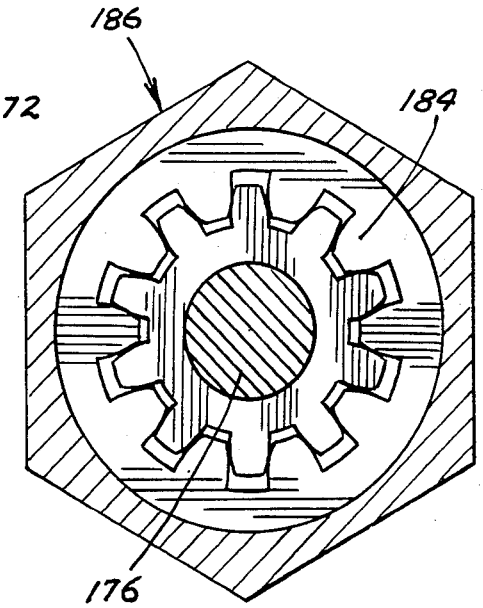
FIG. 14

REGENERATIVE HEAT AND HUMIDITY EXCHANGING APPARATUS

BACKGROUND OF THE INVENTION

1. Field of the Invention

This invention relates generally to regenerative heat exchanging apparatus for transferring heat and humidity from one gaseous fluid to another, and pertains more particularly to apparatus employing a plurality of media disks mounted for rotation so that segments thereof are continuously moved from one gaseous medium to the other.

2. Description of the Prior Art

The prior art is replete with various types of apparatus of the regenerative heat and humidity exchanging type. Most of those that I am familiar with are employed for industrial purposes. Consequently, they are relatively large and costly. In a number of instances they are intended to make use of waste heat, transferring some of the waste heat to air requiring a more elevated temperature. Not only is such equipment bulky and complex, but it is far too expensive for domestic use. Furthermore, it is relatively inefficient.

SUMMARY OF THE INVENTION

Accordingly, one important object of my invention is to provide heat and humidity exchanging apparatus of the regenerative type that will be highly efficient, thereby encouraging its widespread use, especially in conjunction with domestic installations. More specifically, an aim of the invention is to provide a multi-stage matrix construction, the media element of each successive stage contributing to an improved overall performance and efficiency. Additionally, the invention provides a highly effective seal between each stage which further contributes to an increased efficiency.

Another object of the invention is to provide regenerative heat and humidity exchanging apparatus that will be relatively inexpensive to manufacture, thereby encouraging its widespread use for domestic applications. Also, it is an aim of the invention to provide apparatus that is quite compact so that it can be more readily installed in homes and small buildings.

Another object is to provide an automatic cleaning feature in which the media elements can be effectively and automatically washed with a water spray. In this regard, it is also within the contemplation of the invention to employ the same water spray for increasing the moisture level of the fluid to be heated or cooled, as the case may be, and hence assist in controlling the humidity within the building having my apparatus installed therein.

Yet another object is to provide apparatus of the foregoing character in which air infiltration from the outside to the inside of the building is minimized when the apparatus is shut down or turned off.

Another object of the invention is to provide regenerative heat and humidity exchanging apparatus that will require little or no maintenance, and even when maintenance is necessary those components requiring attention can be easily serviced and replaced if need be.

Still further, the invention lends itself readily to utilizing supplemental heat provided by an electric heat element when circumstances justify.

Briefly, my invention envisages a stack of media disks that are pervious to the flow of air or other gases. The disks are continuously rotated in one direction within a housing so as to constantly move segmental portions from one parallel passage to another, the passages being arranged so that heated humidified air or gas flows in one direction and the air or gas to be heated and humidified flows in an opposite parallel direction. The rotatable disks are located in close proximity with respect to stationary separators that are configured so that any leakage from one gaseous medium to the other is for all intents and purposes obviated. Inasmuch as the various media disks are stacked so as to provide a plurality of stages through which the gas or air passes, a highly effective and efficient heat and humidity exchange apparatus is provided when practicing the teachings of my invention. Provision is made for automatically cleaning the media disks whenever it becomes necessary to do so. In this regard, the stationary separators are grooved so as to direct water in a proper direction so that it is sprayed directly onto radial portions of the various disks. Ths same moisture can be used to control the humidity of air within the building. Inasmuch as it is planned that my apparatus will be installed in homes and relatively small buildings, a unique flapper valve mechanism is incorporated into the apparatus so as to reduce to a minimum any air infiltration from the outside to the inside of the building when the apparatus is not in operation.

BRIEF DESCRIPTION OF THE DRAWINGS

FIG. 1 is a perspective view of apparatus exemplifying my invention, portions of the housing having been broken away in order to expose to view certain components contained in the housing;

FIG. 12 is a longitudinal vertical sectional view through the drive mechanism for rotating the media disks;

FIG. 13 is a transverse sectional view of the drive mechanism taken in the direction of line 13—13 of FIG. 12, and FIG. 14 is a transverse sectional view taken in the direction of line 14—14 of FIG. 12.

DESCRIPTION OF THE PREFERRED EMBODIMENT

Figure 2:
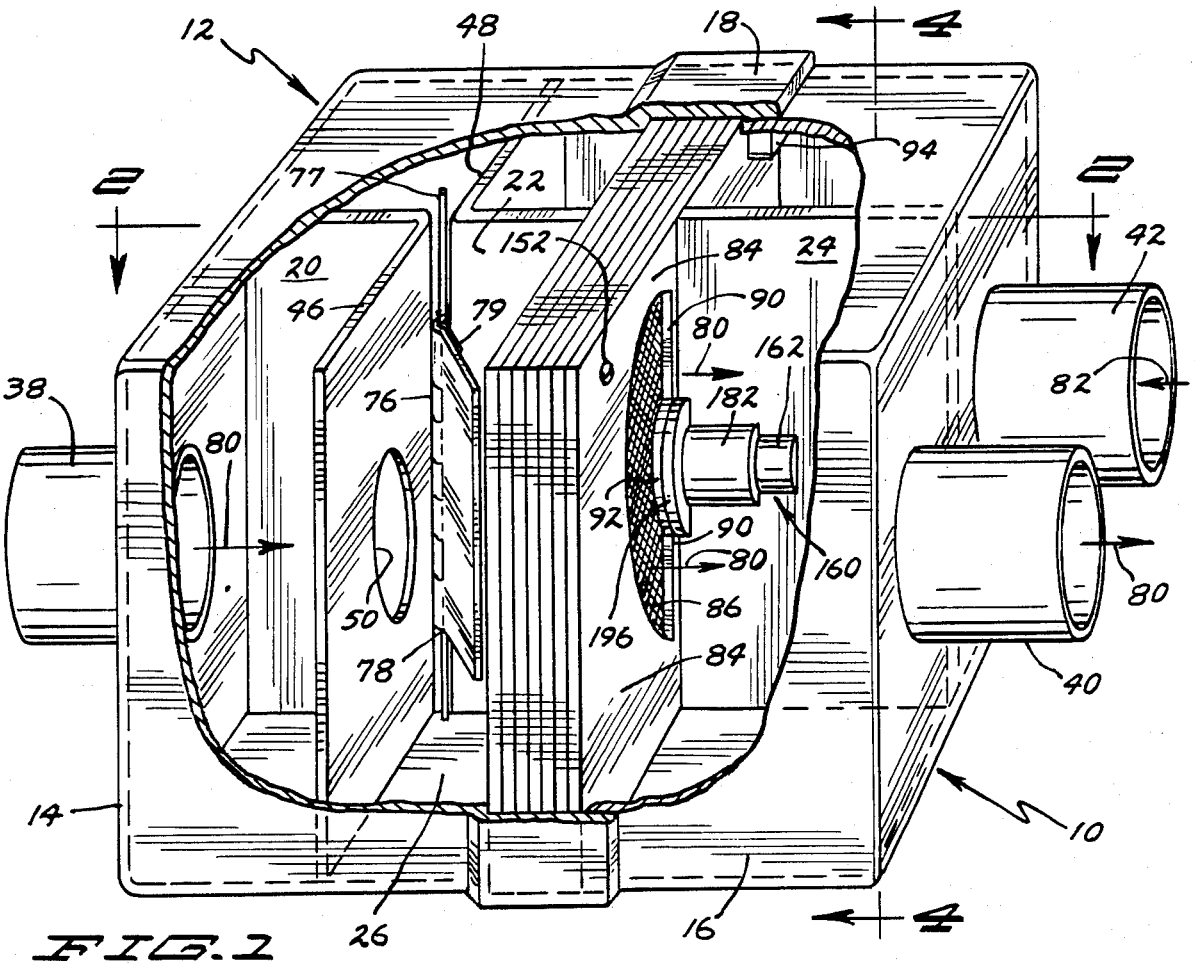
FIG. 2 is a top plan view of my apparatus in operation with the top of the housing removed, the view being taken in the direction of line 2—2 of FIG. 1.

Regenerative heat and humidity exchanging apparatus exemplifying my invention has been denoted generally by the reference numeral 10. From FIGS. 1 and 2 it will be discerned that the apparatus 10 includes a housing 12 composed of plastic shell sections 14 and 16 which fit together by reason of an offset flange 18 integral with the shell section 14. If desired, any number of self-tapping screws extending through the flange 18 into the marginal portion of the section 16 can be employed; it is not deemed necessary to show these screws because other fastening means can be employed.

As best understood from FIG. 2, there are several longitudinal divider panels 20, 22 and 24. It will be observed that the divider panels 22 and 24 are separated somewhat for a purpose presently to be explained. It is to be appreciated, though, that the divider panels 20, 22 and 24, as their name implies, divide the interior of the housing 12 into two passages 26 and 28. These passages are in a parallel relationship with each other, the remaining surfaces thereof being defined by the walls of the housing 12 as is believed obvious from both FIGS. 1 and 2. The passage 26 is provided with an inlet opening 30 and an outlet opening 32, whereas the other passage 28 is provided with an inlet opening 34 and an outlet opening 36. Four conduits 38, 40, 42 and 44 are shown fragmentarily. More specifically, the rather short conduit 38 is connected to the shell 14 at the inlet opening 30 of the passage 26 and the conduit 40 is attached to the shell 16 at the outlet opening 32 of this passage. In the same manner, the conduit 42 is connected to the shell 16 at the inlet opening 34 of the passage 28 and the conduit 44 is similarly connected to the shell 14 at the outlet opening 36 of the passage 28. As the description progresses, it will be explained how the conduits 38-44 are connected into a ventilating system for home use.

At this time, attention is called to two transverse partitions 46 and 48, the partition 46 having an opening 50 therein and the partition 48 an opening 52 therein. Regarding the transverse passage 46 and its opening 50, it will be seen that a fan 54 having a drive motor 56 is mounted to this partition 46 through the agency of a bracket 58 and screws 60. Mounted in virtually the same manner, although facing in an opposite direction, is a fan 62 having a drive motor 64 which is attached to the partition 48 by means of a bracket 66 and screws 68. It will be appreciated that the fans 54 and 62 could be located elsewhere in the passages 26 and 28, respectively, more specifically nearer the conduits 40 and 42.

Inasmuch as, say, the conduits 38 and 44, when the apparatus 10 functions in a ventilating capacity, might very well lead to the outside of the home, it becomes important to prevent an ingress of outside air into the home when the apparatus 10 is shut down, that is, when the fans 54 and 62 are not running. Therefore, it is within the contemplation of my invention to employ a flapper valve 70 which includes integral flap portions 72 and 74, both of which flap portions 72 and 74 appear in FIGS. 2 and 3.

The manner of pivotally mounting the flapper valve 70 is susceptible to variation; however, for the sake of simplicity it will be assumed that the valve is of sheet metal and that a series of oppositely struck knuckles 76 (FIG. 1) have been centrally formed for the accommodation of a relatively long hinge pin 77 having its upper and lower ends anchored to the top and bottom walls of the shell 14. To maintain the flapper valve 70 at the proper height for the openings 50 and 52, a C-washer 78 (FIG. 1) can be pressed into an annular groove (not visible).

From FIG. 2 it will be seen that there is a torsion spring 79 that normally biases the flap valve 70 in a direction such that the two flap portions 72 and 74 close the openings 50 and 52 when the fans 54 and 62 are not functioning. In this way, unwanted air can be prevented from entering the dwelling through either opening 30 or 36, assuming that the conduits 38 and 44 extend to the exterior of the building. Of course, when the fans 54 and 62 are operating, the air movement acts against the flap portions 72 and 74 to overcome the biasing action of the return spring 79.

It may be of assistance to apply arrows indicating the direction of air or gas flow when the two fans 54 and 62 are operating. Therefore, the sequence of arrows 80 denotes the path of air or gas through the passage 26 and the arrows 81 similarly indicate the flow of air or gas through the passage 28. Consequently, from the information given up to this moment, it should be obvious that the passages provide for an axial flow of air or gas in opposite directions through the parallel passages 26 and 28.

Figure 4:
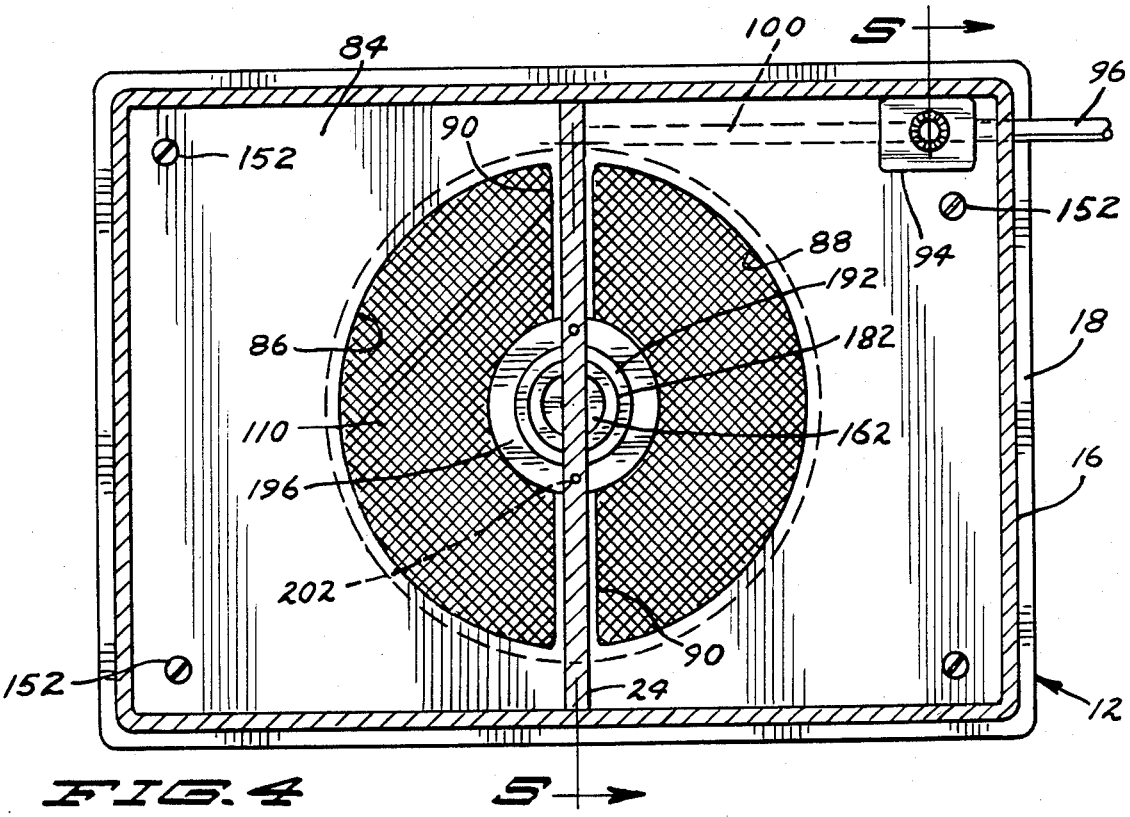
FIG. 4 is a transverse sectional view taken in the direction of line 4—4 of FIG. 1.

Referring to FIG. 4, it will be noted that a mounting plate 84 extends transversely with respect to the entire width of the housing 12, actually intersecting both axial passages 26 and 28. Only one-half of the mounting plate 84 is visible in FIG. 1 but the complete plate 84 can be seen in FIG. 4. The mounting plate 84 is formed with two semi-circular openings 86 and 88 through which the air or gas in each passage 26 and 28 passes. The semi-circular openings 86, 88 are formed by a central vertical strip 90 having a rounded enlarged portion 92 (FIG. 1) midway therein which contains a circular opening (not visible).

Supported on the mounting plate 84 is a solenoidoperated water control valve 94 having an inlet pipe 96 attached thereto which is connected to a suitable water supply. From FIG. 4, it will be perceived that the solenoidoperated valve 94 is located in the upper right hand corner of the mounting plate 84. From FIGS. 5 and 6 it will be discerned that the valve 94 is in communication with a hole 98 extending through the plate 84 to a horizontal groove 100 that leads to the upper end of a vertical groove 102 that extends downwardly for supplying water to be used in cleaning certain parts yet to be described; the water can also be used in supplying moisture to the interior of the building having my apparatus 10 installed therein. The manner in which both the cleaning action and the humidifying is achieved is better reserved for discussion hereinafter. At this time, however, attention is directed to a hole 106 at the bottom of the mounting plate 84 which has a drainpipe 108 connected thereto so that any unused or excess water can be carried away and disposed of.

Playing an important role in the practicing of my invention is a plurality of relatively thin media disks 110 which are pervious to the air or gas that is to flow through the passages 26 and 28. The disk 110 in each instance has a central hexagonal hole 112. Secured to each disk 110 is a hub or ring 114 having a hexagonal hole 116 therein which conforms in size to the hexagonal hole 112; however, the periphery of the hub or ring 114 is circular for a purpose presently to be pointed out.

Figure 8:
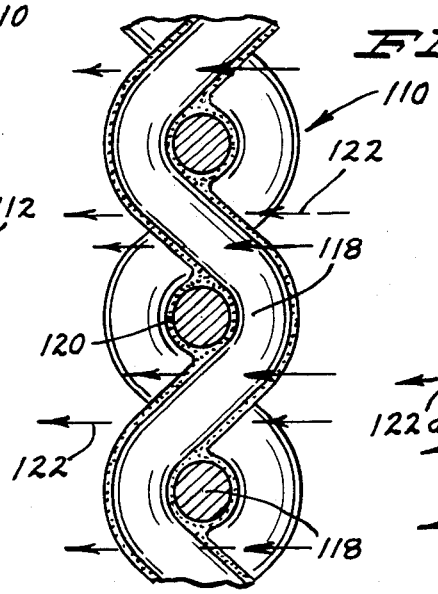
FIG. 8 is a sectional detail taken in the direction of line 8—8 of FIG. 7 in order to depict the mesh construction made use of in this type of disk.

It will be well at this stage to examine FIG. 8 which depicts the mesh configuration of the disk 110. More specifically, the disk 110, as can be discerned from FIG. 8, is of screen material which is composed of criss-crossing metal or plastic strands 118 having a coating 120 thereon which is designed to improve humidity transfer characteristics. More specifically, the coating 120 can be simply an anodized surface or may include a suitable chromate; on the other hand, the coating may comprise a latex paint, $Al_2O_3$ pigment, a $CaCO_3$ pigment, activated charcoal pigment, or it can merely consist of an appropriate surface treatment, such as by plating or etching to increase the surface area. Whatever coating 120 is utilized, it should be sufficiently thin so as to not interfere with the flow of air or gas through the disk 110. Thus, arrows 122 have been applied to FIG. 8 so as to graphically denote the porosity provided by the screen-like material constituting the particular media disk 110 that has just been alluded to. Of course, a number of media disks 110 are arranged in series so as to constitute a plurality of stages, all as will become manifest as the description progresses.

Figure 9:
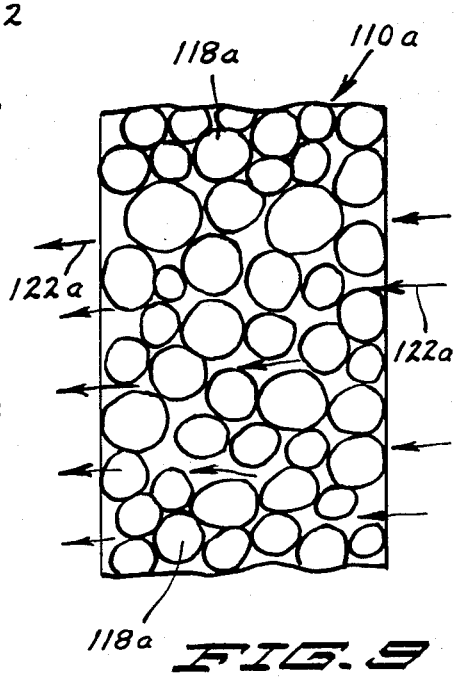
FIG. 9 is a sectional view corresponding to FIG. 8 but portraying a modified disk construction.

Whereas the screen-like disk 110 constitutes one embodiment that can be used in practicing my invention, a modification thereof has been shown in FIG. 9 being denoted by the reference numeral 110*a*. Instead of the criss-crossing strands 118, in this embodiment a multiplicity of somewhat irregularly shaped particles or balls 118*a* are appropriately adhered together so as to provide the necessary degree of porosity for the flow of air or gas therebetween, all as indicated by the arrows 122*a*. The porosity can be achieved by foaming or fusing the small balls 118*a*. What is essential, though, is that the media disk 110*a*, which constitutes a second form that the disk 110 may assume, be pervious so that air and/or gas can readily pass therebetween. It is also within the purview of the invention to utilize a surface treatment for the irregularly shaped balls 118*a* if found desirable to do so. In other words, the balls 118*a* can have a surface which enhances or improves the humidity transfer capability of each disk 110*a*.

Figure 6:
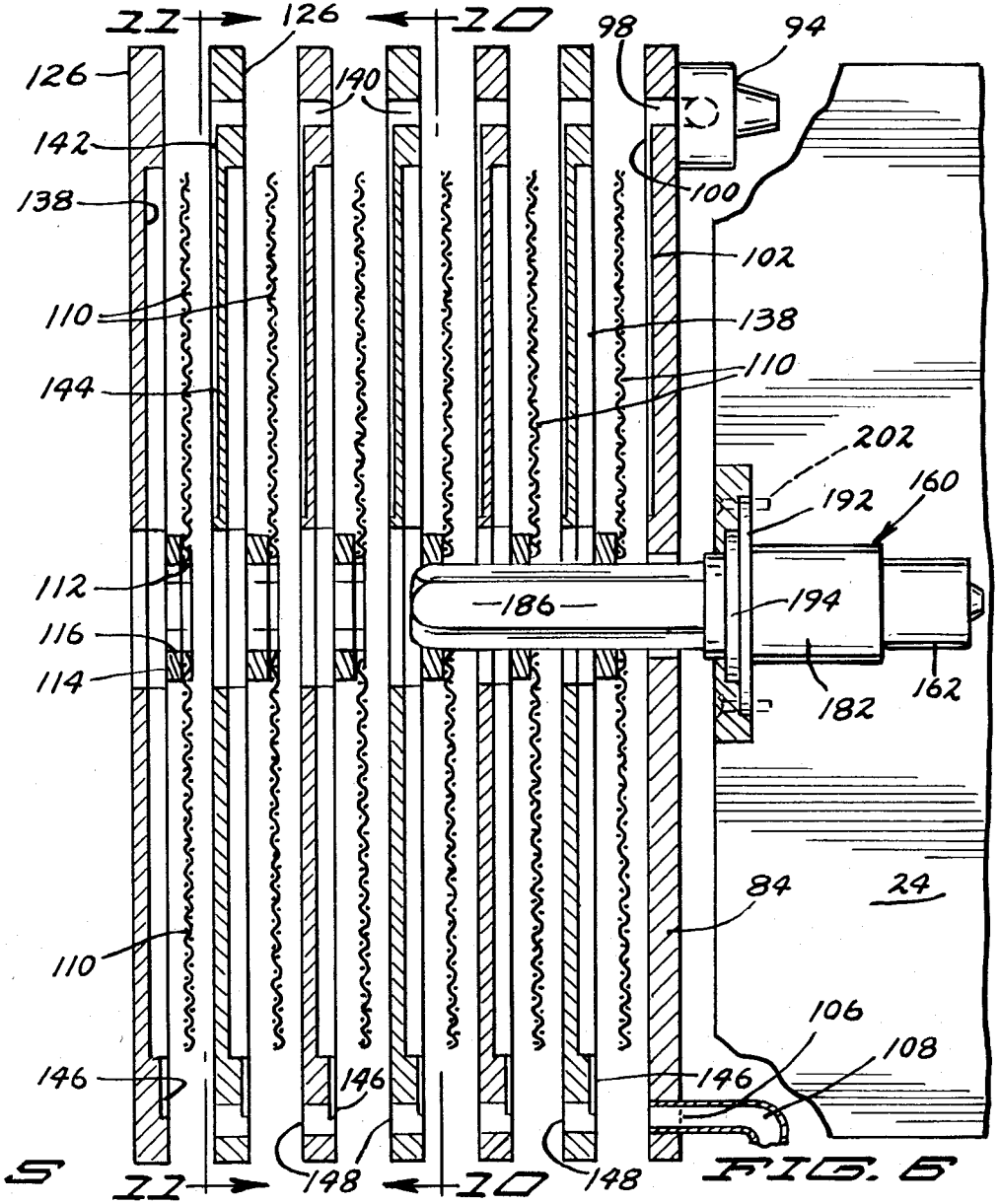
FIG. 6 is an exploded view corresponding to FIG. 5, the separation of the disks and separators showing to better advantage the structural configuration of these parts.
Figure 5:
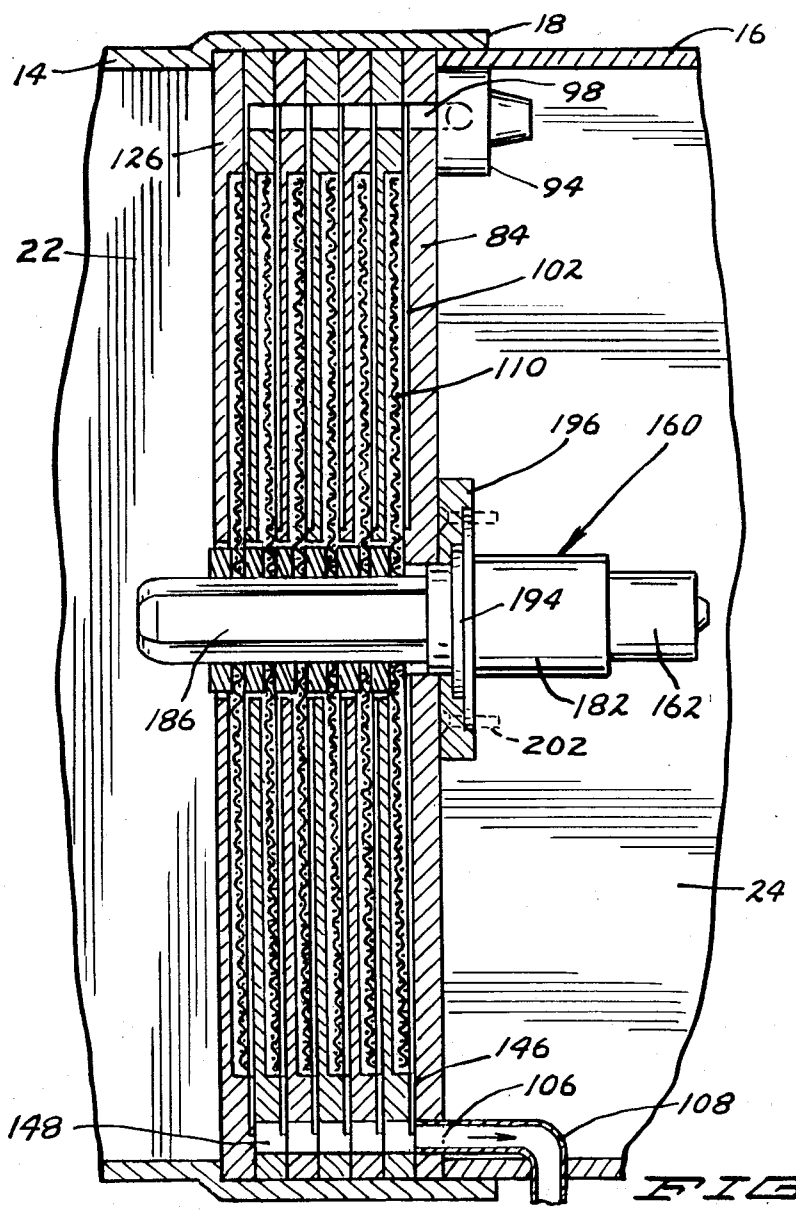
FIG. 5 is a vertical sectional view taken in the direction of line 5—5 of FIG. 4 for the purpose of illustrating the manner in which the media disks are mounted for rotation with respect to the stationary separators.
Figure 7:
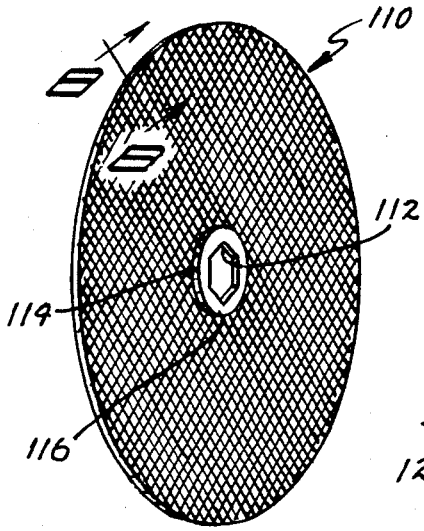
FIG. 7 is a perspective view of a screen-type media disk that can be utilized when practicing my invention to permit fluid to flow therethrough.
Figure 10:
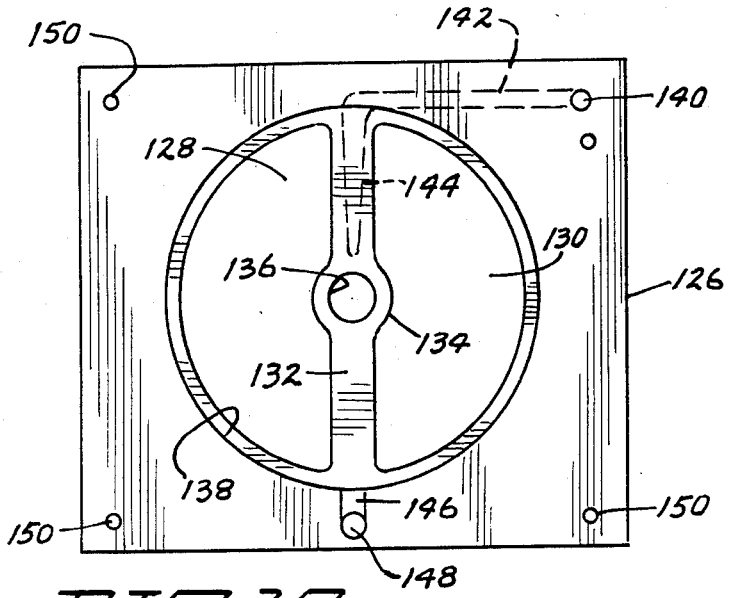
FIG. 10 is an elevational view of one side of one of the separators, the view being in the direction of line 10—10 of FIG. 6.
Figure 11:
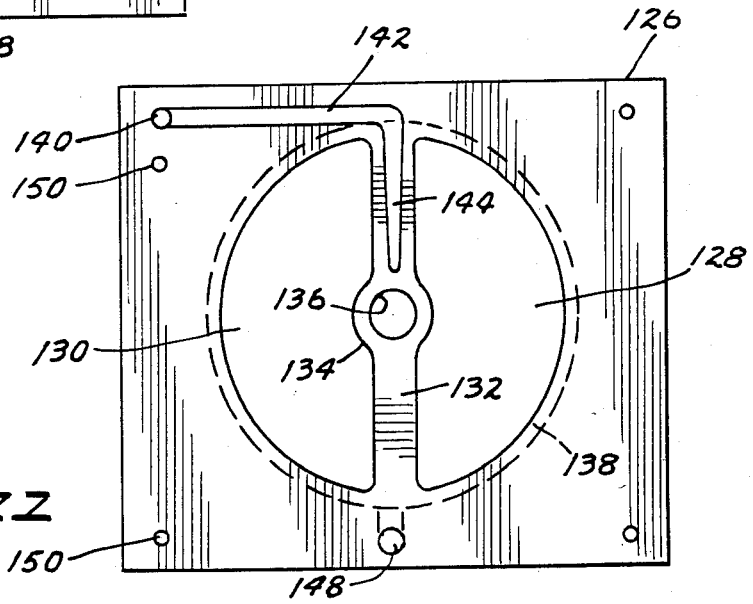
FIG. 11 is an elevational view of the other side of the separator shown in FIG. 10, the view being in the direction of line 11—11 of FIG. 6.

As can be seen in FIGS. 5 and 6, a matrix composed of six disks 110 has been shown. From FIG. 5, it will be perceived that one face of the circular disk 110 at the right confronts one side of the previously mentioned mounting plate 84. However, it is important to appreciate that there is a plate-like separator identified by the reference numeral 126 for each of the disks 110. One of the separators 126 is shown in FIGS. 10 and 11, FIG. 10 depicting the side of the separator 126 that faces toward the mounting plate 84. From FIGS. 10 and 11 it will be noted that the separator 126 has semi-circular openings 128 and 130 therein which conform generally to the semi-circular openings 86 and 88 formed in the mounting plate 84. The openings 128 and 130 are formed by a central vertical strip 132 having rounded enlarged portion 134 midway therein which contains a circular opening or hole 136 which is in registry with the earlier mentioned opening in the enlarged portion 92 of the mounting plate 84.

As best understood from FIG. 10, each separator 126 is formed with an annular recess 138 which is of sufficient diameter to accommodate the circular disk 110 that is intended to rotate therein. The nested relationship of the disks 110 in each recess 138 can be seen in FIG. 5 and also is apparent from the exploded relation illustrated in FIG. 6.

It can be understood from FIGS. 5 and 6 that the vertical strips 132 have a thickness less than the thickness of the separator 126 by reason of the recess 138. Consequently, assuming that the separator 126 has a thickness from one face or side to the other of 5/16 inch, then the annular recess 138 can be of the order of $\frac{1}{8}$ inch deep so as to rotatively receive therein its particular disk 110 which can have a thickness aproximating 3/32 inch (actually just slightly less than the depth of the recess 138). The material constituting each separator 126 is of some importance inasmuch as it should provide as little friction with respect to the particular media disk 110 that is to be rotatable with respect thereto; polyethylene is a satisfactory plastic material.

It will be recalled that the mounting plate 84 has formed therein a hole 98 which is in communication with the water control valve 94. Similarly, each separator likewise has a hole 140, each of which is aligned with the hole 98 in the plate 84 during assembly. When the separators 126 are stacked together, as pictured in FIG. 5, then the various holes 140 form a manifold for the flow of water therethrough when the solenoid-operated valve 94 is open. As with the horizontal groove 100 in the mounting plate 84, each separator 126 has a similar horizontal groove 142 which extends from its hole 140 to the upper end of a vertical groove 144 that corresponds to the previously mentioned vertical groove 102 in the mounting plate 84. Inasmuch as each horizontal groove 142 is in communication with the hole 140 in its plate 84, it will be appreciated that water can be directed horizontally and then vertically by reason of these two grooves 142, 144 and hence sprayed into the particular disk 110 as it is rotated relative to the vertical grooves 144. A short vertical groove 146 extends downwardly from the bottom of each annular recess 138 into a drainhole 148, the various drainholes 148, as can be seen from FIG. 5, causing any excess water to be directed toward the hole 106 in the mounting plate 84 and thence into the drainpipe 108. The various grooves 142, 144 and 146 that have just been described as far as the separators 126 are concerned can be approximately 1/16 inch deep.

Inasmuch as the separators 126 are to be held in a stacked relationship, suitable tie bolt holes 150 are employed, there being a tie bolt 152 extending therethrough and through holes correspondingly located in the mounting plate 84. It will be understood that the tie bolts 152 hold the various separators 126 in a face-to-face relationship. However, the annular recess 138 in each separator 126 is sufficiently deep in an axial direction so as to permit the particular disk 110 rotatably received therein to rotate without difficulty or any objectionable friction.

The manner in which the various media disks 110 (or 110*a*) are rotated becomes important because at times, although infrequently, they will have to be replaced or cleaned where the water is perhaps so hard that the porosity of each disk 110 is lessened owing to it becoming clogged with calcium carbonate, calcium sulphate, other salts, or simply by particles of dirt. Consequently, attention is now directed to a drive mechanism indicated generally by the reference numeral 160 comprising an electric motor 162 having a shaft 164 that projects into an eccentric or crank member 166 that also functions as a counterweight as can be seen in FIG. 12. Somewhat offset from the axis of the motor shaft 164 is a crank pin 168 having one end received in the member 166. While one end of the crank pin 168 is embedded or press-fitted in the eccentric member 166, its other end is free turning within one end of a "dog bone" gear member 170 having a first spur gear 172 at one end thereof and a second spur gear 174 at the other end thereof, there being a cylindrical shank 176 extending between the two spur gears 172 and 174 to maintain the gears in a spaced apart and torque-transmitting relationship.

As best understood from FIG. 13, it will be observed that the spur gear 172 is in mesh with, and orbits within, a fixed internal gear 178, the teeth of which are integral with an internally directed flange 180 which is an integral part of a sleeve member 182 having press-fitted therein the motor 162.

The spur gear 174 of the member 170 is loosely engaged with an internal gear 184 integral with one end of a drive tube 186.

The member 170 wobbles slightly as it is rotated by the crank pin 168. Therefore, a pin element 188 is formed within the closed end of the drive tube 186, projecting into a recess 190 provided in the end of the dog bone member having the spur gear 184 thereon. Only a small clearance or loose fit between the pin 188 and the sides of the recess 190 is required to enable the wobble movement that has just been referred to.

From FIG. 14 it will be noted that the exterior of the drive tube 186 is hexagonal, the hexagonal dimensions being sufficient so that the hexagonal holes 112 in the media disks 110 and the hexagonal holes 116 in the hubs 114 will readily slide thereover, yet furnish a keying and aligning action so that there is no relative rotation between the drive tube 186 and the various disks 110 it is to cause rotation of.

The manner in which the drive mechanism 160 is mounted will now be described. In this regard, the sleeve member 182 having the internally directed flange 180 and the internal gear 178 formed therein has an external flange labeled 192. Also, as can be learned from FIG. 12, the drive tube 186 has an external flange 194 which rotatively abuts or rides against the end of the sleeve member 182 having the flange 180 thereon.

A ring member labeled 196 has a stepped configuration forming recesses 198 and 200, the recess 198 receiving therein the flange 192 on the sleeve member 182, whereas the recess 200 is dimensioned so that it loosely receives and provides a bearing surface for the flange 194 therein, thereby permitting rotation of the flange 194 and the entire drive tube 186 with which it is integral. The ring member 196 has vertically aligned horizontal holes drilled therein for the accommodation of two threaded screws 202, the two being vertically aligned as can be seen in FIG. 12. The flange 192 on the sleeve member 182 has appropriately aligned holes through which the screws 202 extend, the divider partition or panel 24 having tapped holes for the threaded reception of the end portions of these two screws 202.

From the description just presented it should be evident that the motor shaft 164 can rotate at a relatively high speed, yet the drive tube 186 having the hexagonal cross-section is rotated at a relatively low speed. Thus, there is a speed reduction effected by reason of the offset or crank action provided by the crank pin 168. The effective length of the crank is relatively short because the pin 168 is offset only slightly from the axis of the motor shaft 164. Hence, the spur gear 172 at the right, as seen in FIG. 12, is rotated slowly within the internal gear 178 formed on the inner flange 180 of the sleeve member 182. This reduced speed is transmitted through the dog bone gear member 170 to the spur gear 174 at the other end thereof. The spur gear 174, being in mesh with the internal gear 184, which is an integral part of the drive tube 186, with the result that the drive tube 186 is driven at a comparatively low speed with respect to the speed of the motor shaft 164.

It is important at this time to point out that the various media disks 110 by reason of their hexagonal holes 112 and the hexagonal holes 116 in the hubs 114 associated with the disks 110 permit the disks 110 to be rotated relative to the separators 126, yet whenever the media disks 110 are to be inspected, scrubbed or replaced, then the shell 14 can be detached from the shell 16 so as to provide access to the stacked separators 126, mounting plate 84 and the various media disks 110 rotatively associated therewith. Stated somewhat differently, as is believed readily apparent from FIG. 5, the stacked separators 126, mounting plate 84 and the various media disks 110 therebetween can be pulled to the left as a unit. Then the stay bolts 152, if employed, can be taken out first. The construction of the drive mechanism 160, more specifically the hexagonal configuration of the drive tube 186 allows this. It will be appreciated that no part of the mechanism 160 need be removed. By the same token, the separators 126, mounting plate 84 and their rotatable media disks 110 can be reassembled as a unit onto the hexagonal drive tube 186.

OPERATION

Although an overall or complete ventilating system has not been disclosed, it will be recognized that the conduit 38 can extend from the exterior of a home to the inlet opening of the shell 14. Hence, air is drawn in in the direction of the arrows 80 when the fan 54 is in operation. The incoming air impinges against the portion 72 of the flap valve 70, overcoming the action of the torsion spring 79 so that the valve 70 assumes the angular position pictured in FIG. 2. The air flows completely through the passage 26, as denoted by the arrows 80, exiting through the conduit 40 which may very well be connected to the duct system of the building in which my apparatus 10 is installed.

Inasmuch as each separator 126 is provided with a semi-circular opening 128, all of which openings 128 are in alignment or registry with each other (and with the opening 86 in the mounting plate 84), the air not only passes through these aligned semi-circular openings 128, but also passes through the various media disks 110 that are rotatably mounted between the separators 126, as well as through the semi-circular openings 86 in the mounting plate 84. Hence, air (or other gas) can flow completely through the passage 26 into the conduit 40 for distribution throughout the building.

Assuming for the sake of discussion that the air passing inwardly through conduit 38 is relatively cool air and that the air passing outwardly through conduit 42 is relatively warm air, rotation of the various media disks 110 in the path of the warm air flowing through the passage 28 will absorb heat from such warm air, releasing, however, the heat that they pick up as segmental portions of the disks 110 are rotatably advanced from the passage 28 to the passage 26. The warm air can be derived, say, from internal home air which would need to be exhausted to provide for normal fresh air exchange. Of course, when the air flowing through the passage 26 is warmer than that flowing through the passage 28, then a reverse situation occurs, for heat is then transferred from the passage 26 to the passage 28. In some instances the warm air can be derived from the flue system of the home, utilizing heat that would otherwise be lost up the chimney.

Recapitulating somewhat, it must be recognized that the semi-circular openings 130 in the separators 126 and the opening 88 in the mounting plate 84, allow air to flow through the passage 28 in the direction of the arrows 81. Thus, as the air flows in the direction of the arrows 81, it impinges upon each of the media disks 110 in turn as it flows therethrough. Once again it should be borne in mind that each disk 110 is pervious to the flow of air. As far as the disks 110 are concerned, the porosity is provided by the screen-like mesh and as far as the modified disks 110*a* are concerned the porosity is simply around the small beads or balls 118*a*. Consequently, continuous rotation of the disks 110 (or 110*a*) transfer heat from the passage 28 to the passage 26 through air flow indicated by arrows 80.

It is important to take into account that the air flows through a number of media disks 110. While six have been shown, a larger or smaller number can be utilized. Each media disk 110 constitutes a thermal stage. Thus, when the incoming air in the passage 26 first strikes the disk 110 at the left in FIG. 5, it picks up a certain amount of heat that has been transferred to the passage 26 via this particular disk 110 from what amounts to the last stage in the passage 28. As the air continues its flow to the right as viewed in FIG. 5, it then passes through the next media disk 110 and so on through each of the disks 110 until it has passed through the entire matrix of disks 110. Consequently, my apparatus 10 provides a multi-stage construction, both in the direction of the arrows 80 and in the opposite direction as indicated by the arrows 81, each disk 110 being at a particular temperature that is influenced by the thermal gradient prevailing between the passage 26 and the passage 28. In this way, the efficiency of my apparatus 10 is enhanced by reason of the various stages that are provided.

It should be also noted that by virtue of each disk 110, being rotatable within the annular recess 138 formed in the separator 126 with which it is rotatably associated, prevents any air from taking a route other than through the matrix of media disks 110. More specifically, it can be appreciated that air cannot flow to any significant extent around the periphery of the disks 110 because the disks 110 confront the respective separators 126 so closely that the air must pass only through the segmental portions of the disks 110 that are at any given moment in registry with the semi-circular openings 128, 130 contained in the separators 126. Of course, the vertical strips 132 provide the needed sealing in a direct lateral direction between the passages 26 and 28. Owing to the close fit existing between the edges of the hexagonal holes 112 at the center of the disks 110 and the hexagonal holes 116 in the hubs or rings 114 attached thereto, there can be no leakage of air in this region either. As far as the sealing action just described is concerned, the sealing is equally excellent as far as air flow through the passage 28 is concerned.

Consequently, the air flow is constrained to go through the pervious disks 110 (or 110*a*) themselves, and, absorbing a relatively large amount of heat that is transferred into the passage 26 from the passage 28. At times it may be desirable to add more heat to the air flowing through the passage 26 than that picked by the disks 110 from the passage 28. Therefore, it is within the contemplation of my invention to install an electric heating element in the passage 26, preferably between the conduit 32 and the mounting plate 84.

In the same manner just described for heat exchange, humidity exchange between passages 26 and 28 is accomplished through rotation of media disks 110. In addition the moisture transfer can be enhanced by using a humidity retaining surface coating 120 which, as already explained, is designed to improve humidity transfer characteristics.

It should be recognized, though, that whatever differential amount of moisture entrained in the air within the passage 28, or at least a substantial proportion thereof, is transferred by the disks 110 into the passage 26 when the air in the passage 28 contains a greater amount of moisture. Conversely, when the air in the passage 26 contains a greater amount of moisture, then this greater amount of moisture, or a substantial percentage thereof is transferred to the passage 28. In other words, whatever passage has a greater amount of moisture contributes moisture to the passage having a lesser moisture content. Consequently, there is a desirable equalization of humidity beween the air flowing in the two conduits 40 and 42.

Of importance to take into account is that if the incoming air flowing through the passage 26 requires moisture greater than that available through humidity transfer from passage 28, the solenoid water valve 94 can be energized to permit flow of water from the pipe 96 therethrough into the manifold composed of the various holes 98 and 140. Once in the manifold formed by the various holes 98, 140, the water flows horizontally through the grooves 100, 142 and then downwardly through the grooves 102, 144. Once the water is in the vertical grooves 102, 144, passage of segmental portions of the media disks 110 pick up the water which is sprayed thereon and present it to the air stream flowing through the passage 26. The valve 94 can be opened partially to lessen the flow of water or can be opened fully to increase the flow of water. In any event, water not picked up by the air flowing through the passage 26 continues downwardly through the lower grooves 146 into the aligned holes 148 at the bottom which connect with the hole 106 and the drainpipe 108.

Not only can the interior of a dwelling be humidified very readily when utilizing my invention, but the water that is passed through the valve 94 when open can be used to clean the various media disks 110. In this regard, as far as homes are concerned, it frequently happens that the water is quite hard and not always softened sufficiently to remove the carbonates and sulfates which can clog the pores of the media disks 110 (or 110*a*) along with impurities that might be contained in water not completely filtered. By periodically opening the solenoid valve 94, water can be caused to provide a cleaning action in addition to humidifying the air. Actually, the cleaning can be automatic, the solenoid-operated valve being readily susceptible to energization through the agency of a suitable timer (not shown). Hence, the water can be sprayed onto the rotating media disks 110 or 110*a* at predetermined intervals.

During cleaning, if air entering duct 38 is below freezing, fan 54 will be turned off prior to opening water valve 94, to prevent freeze-up. Also, time will be allowed for water drainage through passages 146, 148 and 106 prior to turning fan 54 back on.

Figure 3:
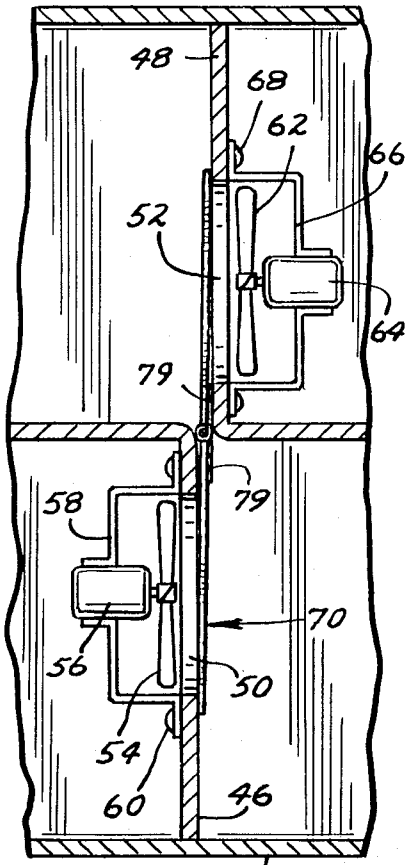
FIG. 3 is a fragmentary detail of FIG. 2 but with the apparatus shut down and hence with the flapper valve closed instead of being open as in FIG. 2.
Figure 2:
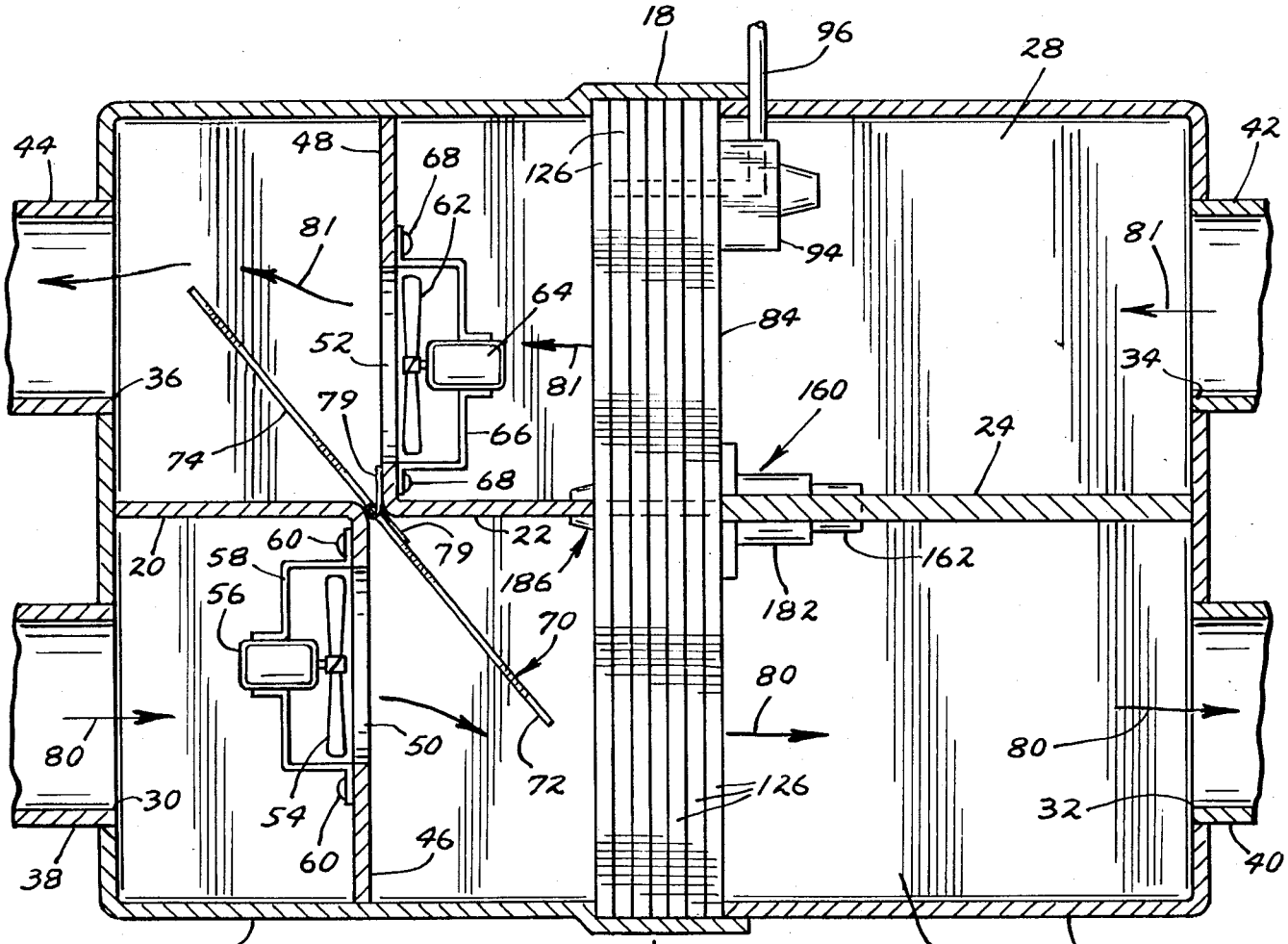

Whenever the fans 54 and 62 are not in operation, then there is no flow of air through either passage 26 or 28 with the consequence that the torsion spring 79 acts in a direction to cause the portions 72 and 74 of the flap valve 70 to move against the partitions 46 and 48 as illustrated in FIG. 3. Consequently, any time that the apparatus 10 is turned off and the fans 54 and 62 not operating, then the flap valve 70 functions to prevent any air infiltration through either conduit 38 or 44 into the dwelling or other building in which my apparatus 10 is installed. However, whenever the fans 54 and 62 are in operation, then the valve 70 is open as can be observed from FIG. 2.

Although it has already been pointed out that the media disks 110, mounting plate 84 and the separators 126 with which they are associated can be removed as a unit, emphasis should be placed upon the uniqueness of the drive mechanism 160. Normally, electric motors are relatively high speed rotational devices. The mechanism 160 that has been referred to is highly effective in providing an exceptional amount of speed reduction so that the drive tube 186 over which the disks 110 are fitted can be readily removed. Of course, it will be appreciated that the shell 14 is first disengaged from the shell 16 to provide access to the stack of separators 126, mounting plate 84 and the matrix of disks 110 associated therewith. Also, it will be recognized that the disks 110, mounting plate 84 and separators 126 are removed as a unit without removing the ring 196 which is attached to the edge of the panel 24 by means of the two screws 202 shown in FIG. 12.

I claim:

1. Regenerative heat and humidity exchanging apparatus comprising a housing providing a pair of passages through which gaseous fluids having different thermal characteristics flow, a portion of each passage being adjacent the other, a partition extending transversely across each of said passages, each partition having an opening therein, a fan associated with each partition opening, a valve means for closing said partition openings when said fans are not operating, said valve means having a flap valve member pivotally mounted so that one flap portion thereof coacts with one partition opening and a second flap portion thereof coacts with the other partition opening, a plurality of rotary disks pervious to the gaseous fluids passing through said passages, means mounting said disks for rotation about an axis so that one segment of each disk at any given moment resides in one of said adjacent passage portions used and a second segment resides in the other of said adjacent passage portions, and a plurality of stationary separators positioned in said housing having a first portion residing in said one passage portion and formed with an opening therein for the passage of a gaseous fluid therethrough and having a second portion residing in said second passage portion also formed with an opening therein for the passage of a gaseous fluid therethrough, there being one of said pervious disks rotatively positioned between adjacent separators, whereby, when said disks are rotated, heat and/or humidity is transferred by each disk from said one passage portion when the gaseous fluid flowing therethrough has a higher thermal or moisture characteristic to said second passage portion when the gaseous fluid flowing therethrough has a lower thermal or moisture characteristic.

2. Regenerative heat exchanging apparatus in accordance with claim 1 in which said disks are made of screen material composed of criss-crossing strands, said strands have a coating thereon.

3. Regenerative heat exchanging apparatus in accordance with claim 1 in which said disks are of particulate material composed of small beads with fluid passages therebetween.

4. Regenerative heat exchanging apparatus in accordance with claim 1 in which one side of at least some of said separators have formed therein grooves for spraying a liquid onto the disk rotatively associated therewith.

5. Regenerative heat exchanging apparatus in accordance with claim 4 including a valve for supplying liquid to said grooves.

6. Regenerative heat exchanging apparatus in accordance with claim 5 including a transverse mounting plate having a hole therethrough and at least some of said separators also having a hole in registry with said mounting plate hole, said mounting plate having a horizontal groove and a vertical groove in communication with the hole in said mounting plate, said grooves in said separators including a horizontal groove and a vertical groove, said horizontal groove of each separator being in communication with mhe hole for that particular separator.

7. Regenerative heat exchanging apparatus in accordance with claim 1 including spring means for biasing said flap valve member in a direction to cause said flap valve member to close both of said partition openings when said fans are not operating, said fans developing sufficient fluid pressure to overcome the biasing action of said spring means to cause opening of said partition opening when said fans are operating.

8. Regenerative heat and humidity exchanging apparatus comprising a housing providing a pair of passages through which gaseous fluids having different thermal characteristics flow, a portion of each passage being adjacent the other, a plurality of rotary disks pervious to the gaseous fluids passing through said passages, means including a rotatable drive member having a free end mounting said disks for rotation about an axis so that one segment of each disk at any give moment resides in one of said adjacent passage portions and a second segment resides in the other of said adjacent passage portions each of said disks having a central opening through which said drive members extends, said drive member is tubular and has an internal gear adjacent its free end, said mounting means including a spur gear in engagement with said internal gear and means for rotating said spur gear to cause rotation of said tubular drive member via said spur and internal gears, and a plurality of stationary separators positioned in said housing having a first portion residing in said one passage portion and formed with an opening therein for the passage of a gaseous fluid therethrough and having a second portion residing in said second passage portion also formed with an opening therein for the passage of a gaseous fluid therethrough, there being one of said pervious disks rotatively positioned between adjacent separators, said separators being stacked with one side of each said separators recessed for the rotative accommodation therein of one of said pervious disks, whereby, when said disks are rotated, heat and/or humidity is transferred by each disk from said one passage portion when the gaseous fluid flowing therethrough has a higher thermal or moisture characteristic to said second passage portion when the gaseous fluid flowing therethrough has a lower thermal or moisture characteristic.

9. Regenerative heat exchanging apparatus in accordance with claim 8 in which said means for rotating said spur gear includes another spur gear, a shank rigidly connecting said spur gears to each other, a fixed internal gear larger than said another spur gear, and eccentric member, a crank pin extending between said eccentric member and said another spur gear, a motor, and a shaft on said motor connected to said eccentric member, said crank pin being axially offset from said motor shaft.

10. Regenerative heat exchanging apparatus in accordance with claim 9 in which said tubular drive member has an external circular flange at the end thereof opposite said free end, and a fixed ring element having an annular recess for rotatively accommodating said external circular flange therein.

11. Regenerative heat exchanging apparatus in accordance with claim 10 including a sleeve member for retaining said motor in one end thereof and having an external flange, said larger internal gear being in the end of said sleeve member at the end thereof opposite the end in which said motor is retained.

12. Regenerative heat exchanging apparatus in accordance with claim 11 in which said sleeve member has an external flange at said other end thereof, and said ring element is additionally recessed for the accommodation therein of the external flange on said sleeve member.

13. Regenerative heat exchanging apparatus in accordance with claim 12 in which said passages are generally parallel, there being a plurality of divider panels between said passages, and said ring element being attached to one of said divider panels.

14. Regenerative heat exchanging apparatus in accordance with claim 13 in which said ring element is attached to an end edge of said one divider panel.

15. Regenerative heat exchanging apparatus in accordance with claim 14 including a mounting plate extending transversely to each side of said one divider panel, said mounting plate also having an opening in each transverse portion thereof in registry with the openings in said separators.

16. Regenerative heat exchanging apparatus in accordance with claim 15 including a valve mechanism mounted on said mounting plate, said mounting plate and said separators each having a hole and grooves formed therein so that water can be sprayed onto said disks as they rotate relative to said separators.

* * * * *

UNITED STATES PATENT AND TRADEMARK OFFICE

CERTIFICATE OF CORRECTION

PATENT NO. : 4,497,361

DATED : Feb. 5, 1985

INVENTOR(S) : David J. Hajicek

It is certified that error appears in the above-identified patent and that said Letters Patent are hereby corrected as shown below:

Column 12, Line 24 the word after "with" should read as follows:--the-- not "mhe".

Signed and Sealed this

*Eighteenth* Day of *June 1985*

[SEAL]

*Attest:*

DONALD J. QUIGG

*Attesting Officer*

*Acting Commissioner of Patents and Trademarks*